United States Patent [19]

Yodock

[11] Patent Number: 4,773,629

[45] Date of Patent: Sep. 27, 1988

[54] HIGHWAY BARRIER

[75] Inventor: Leo J. Yodock, Bloomsburg, Pa.

[73] Assignee: Rose Enterprises, Inc., Bloomsburg, Pa.

[21] Appl. No.: 38,641

[22] Filed: Apr. 15, 1987

[51] Int. Cl.[4] ..... A01K 3/00

[52] U.S. Cl. ..... 256/13.1; 256/19; 256/1

[58] Field of Search ..... 256/13.1, 19, 1

[56] References Cited

U.S. PATENT DOCUMENTS

| | | | |
|---|---|---|---|
| 2,279,942 | 4/1942 | Hausherr | 256/13.1 |
| 3,503,600 | 3/1970 | Rich | 256/13.1 X |
| 3,540,699 | 11/1970 | Guzzardella | 256/13.1 |
| 3,980,279 | 9/1976 | Bofinger | 256/13.1 |
| 4,059,362 | 11/1977 | Smith | 404/6 |
| 4,146,113 | 3/1979 | Gavel | 256/13.1 X |

*Primary Examiner*—Andrew V. Kundrat
*Attorney, Agent, or Firm*—Michael J. Delaney

[57] ABSTRACT

A highway traffic barrier of the New Jersey style is made from semi-rigid plastic material so that it has some elasticity and will act as a shock absorber, while weighing considerably less than the present day New Jersey style barrier made from concrete. The barrier is hollow and contains interior baffles to provide compartments within the barrier. When in use the barrier is filled with a liquid through filling openings at the top of the barrier and has a weight about equal to the present New Jersey style barriers made of concrete. When the barriers are not filled with a liquid, they weigh considerably less than present New Jersey style barriers made of concrete. When not in use, the liquid is discharged through discharge openings near the bottom of the barriers. Each barrier has a groove at each end which is adapted to receive a key so that the barriers may be joined together to form a highway barrier of the required length. Handles are provided along with recesses in the sides of the barrier to facilitate moving of the barriers manually. The handles also act as reflectors when they are placed in recesses in the top of the barriers.

10 Claims, 3 Drawing Sheets

HIGHWAY BARRIER

BACKGROUND OF THE INVENTION

This invention relates to a highway barrier and, in particular, to a highway barrier of the New Jersey style, which is made from semi-rigid plastic material, is hollow and when in use is filled with a liquid.

Present day highway barriers are used to divide opposing traffic lanes. For the most part, such barriers are made from precast, reinforced concrete. A preferred form of barrier is the New Jersey style barrier, which has a relatively wide base having side walls which extend upwardly from the pavement a short distance, thereafter the walls of the barrier extend upwardly and inwardly for a distance and finally the upper portion of the barrier extends upwardly in a vertical plane. The barrier is designed so that when the wheels of a vehicle contact the barrier, the wheels contact the vertical side walls of the base and the vehicle is forced back into its lane of traffic rather than crossing over into the lane of opposing traffic. U.S. Pat. No. 4,059,362 discloses a highway barrier of the New Jersey style.

One disadvantage of a highway barrier made from concrete is the high weight it possesses. A concrete barrier of the New Jersey style weighs about 3,000 pounds for a barrier having a length of fifteen feet. Thus this large weight necessitates special equipment to handle the barriers. It has been estimated that for some road repairs 40% of the dollars expended for the repair are spent on acquiring, delivering and setting up the concrete barriers. Thus, a considerable savings could be realized if a barrier could be made with less weight.

Another disadvantage of a concrete barrier is that concrete has very little ability to absorb shock and reduce damage to vehicles which collide with a concrete barrier.

Still another disadvantage of a concrete barrier is the heavy load to which highways are subjected when the barriers are transported from site to site.

A still further disadvantage of a concrete barrier is the difficulty in placing the barriers due to their high weight.

SUMMARY OF THE INVENTION

It is an object of this invention to provide a highway barrier which is relatively light in weight when the barrier is being transported and moved compared to the present day concrete barriers.

It is another object of this invention to provide a highway barrier which has the ability to absorb shock loads.

It is still another object of this invention to provide a highway barrier which can be transported, stored and handled with relative ease.

It is still another object of this invention to provide a highway barrier which when in place and filled with a liquid weighs about the same as the same style concrete barrier.

The above objects are provided by the highway barrier of this invention which comprises an elongated, hollow container including a base portion having vertical side walls, an intermediate portion having side walls which slope inwardly and upwardly and a top portion having vertical side walls. The container is made from a semi-rigid plastic material and includes a plurality of interior baffles positioned within the container to divide the container into a plurality of compartments of about equal volume with passageways near the top of the container to allow liquid to flow from compartment to compartment. The container has means to allow it to be filled with a liquid and means to discharge the liquid from the container. The container also has recesses at the top of the container to receive a handle/reflector. The handle/reflector may also be placed in recesses near the bottom of the container to act as lifting handles when the barriers are to be moved. The barriers have tapered grooves or keyways at each end arranged to receive tapered keys so that adjacent barriers may be locked to each other.

BRIEF DESCRIPTION OF THE DRAWINGS

FIG. 2 is an end view of the highway barrier of this invention.

DETAILED DESCRIPTION OF THE DRAWINGS

Figure 1:
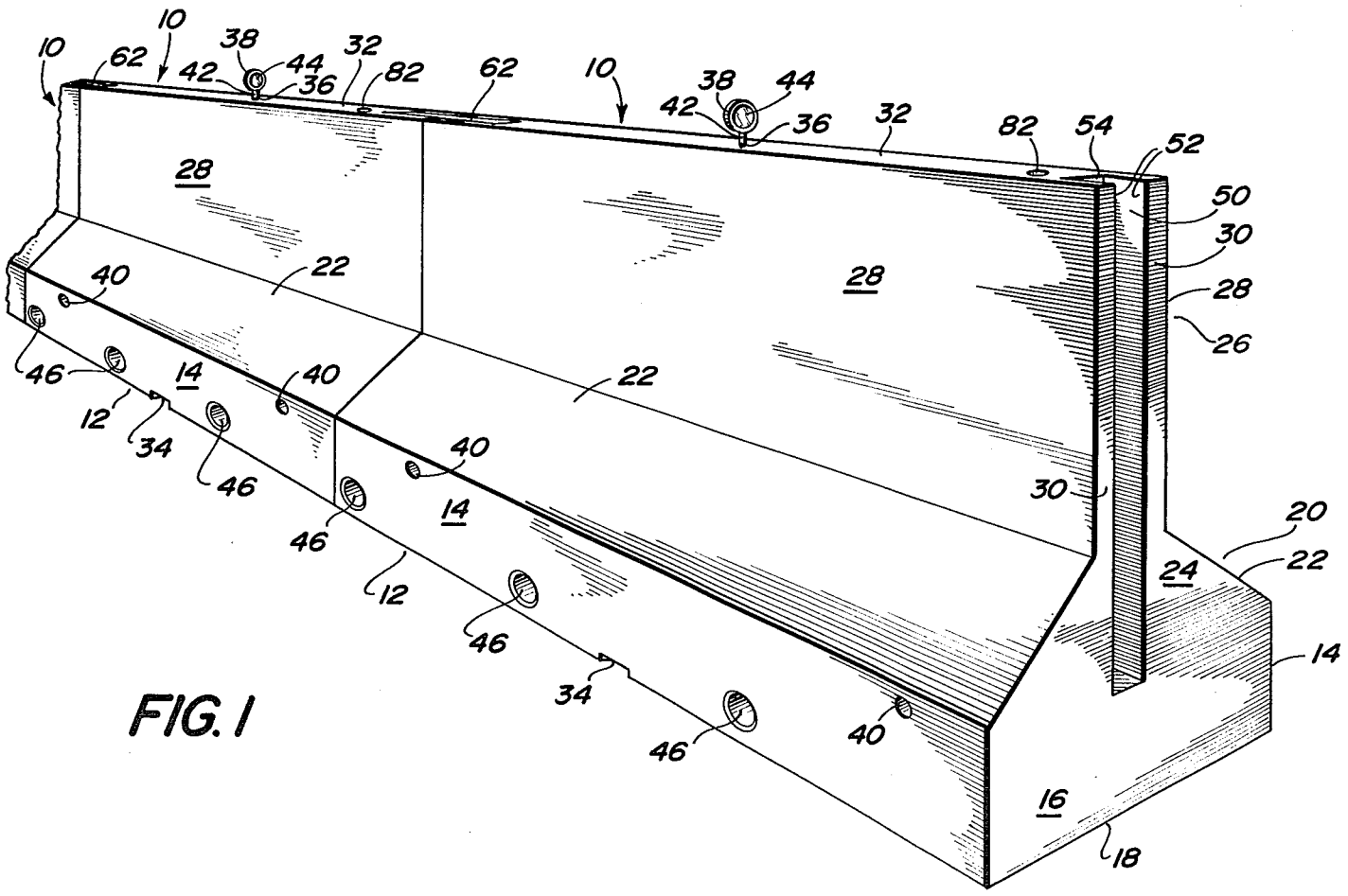
FIG. 1 is a perspective view of the highway barrier of this invention.

In FIG. 1, a number of highway barriers 10 are joined together in a manner thereinafter set forth. Each barrier 10 of this invention comprises an elongated container having a base portion 12 with side walls 14, end walls 16 and a bottom 18. The side walls 14 and end walls 16 rise substantially vertically from and are connected to the bottom 18. An intermediate portion 20 of the barrier 10 has side walls 22 and end walls 24. The side walls 22 of the intermediate portion 20 extend inwardly toward each other and rise upwardly from and are connected to the side walls 14 of the base portion 12. The end walls 24 of the intermediate portion 20 extend vertically and are connected to the end walls 16 of the base portion 12. An upper portion 26 of the barrier 10 has side walls 28, end walls 30 and a top 32. The side walls 28 of the upper portion 26 extend vertically and are connected to the side walls 22 of the intermediate portion 20. The end walls 30 of the upper portion 26 rise vertically and are connected to the end walls 24 of the intermediate portion 20. The top 32 of the upper portion 26 extends substantially horizontally and is connected to the upper ends of the end walls 30 and side walls 28 of the upper portion 26.

Figure 4:
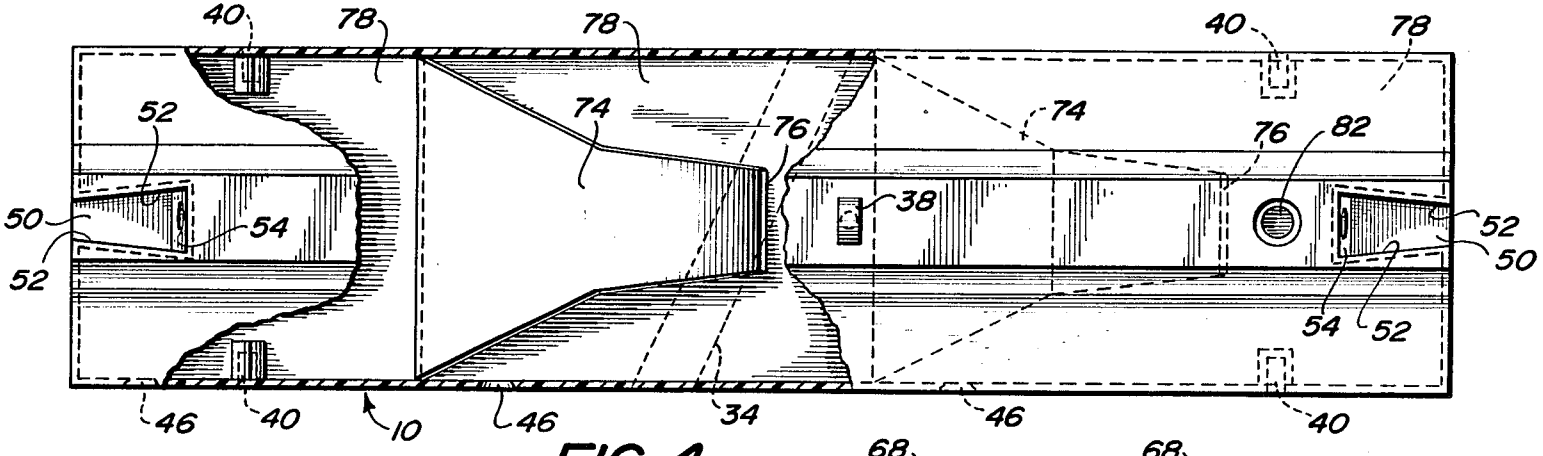
FIG. 4 is a plan view of the highway barrier of this invention with parts broken away to show the interior of the barrier.

The bottom 18 of the barrier 10 includes a transverse recess portion 34 to allow water to run under the barrier 10 from one side of the barrier 10 to the other side, as best seen in FIGS. 1, 2 and 4.

As shown in FIGS. 1 and 4, the top 32 of the barrier 10 includes vertically extending blind holes recesses 36 to receive handle/reflectors 38 which also may be used as carrying handles and reflectors. When used as carrying handles the handle/reflectors 38 are inserted in blind holes or recesses 40 in the side walls 14 of the base portion 12, as shown in FIG. 2, and are used to facilitate lifting and moving the barrier 10. The handle/reflector 38 has a round shaft 42 at one end and a reflector 44 at the other end. When the handle/reflector 38 is in the position shown in FIG. 1 it acts as a reflector to mark the location of a barrier 10 and act as a guide for vehicles.

Referring to FIG. 4, the top 32 of the barrier 10 includes an opening 82 which may be used to supply liquid to the interior of the barrier 10. Suitable means such as a plug or other closure member (not shown) may be used to close the opening 82

As shown in FIGS. 1 and 4, positioned in the side walls 14 of the base portion 12 are a plurality of discharge openings 46 used to discharge liquid from the barrier 10. As shown in FIG. 2, the discharge openings 46 can be closed by any suitable means such as removable plug 48.

As shown in FIGS. 1 and 2, each barrier 10 has a groove or keyway 50 comprising tapered walls 52 and a base 54 extending from the top 32 of the barrier 10 and terminating short of the bottom 18 of the barrier 10. As best shown in FIG. 4 the groove 50 has an outside width less than the width of the base 54 of the groove 50, that is the walls 52 of the groove 50 taper outwardly and towards each other from the base 54 of the groove 50. Positioned in the base 54 of the groove 50 near the top 32 of the barrier 10 is an opening 56 which extends into the inside of the barrier 10. The outside of the opening 56 is beveled to receive the beveled portion 60 of the key 62 shown in FIG. 5 and provide a liquid tight seal between the through opening 64 in the key 62 and the opening 56 in the base 54 of groove 50.

Figure 3:
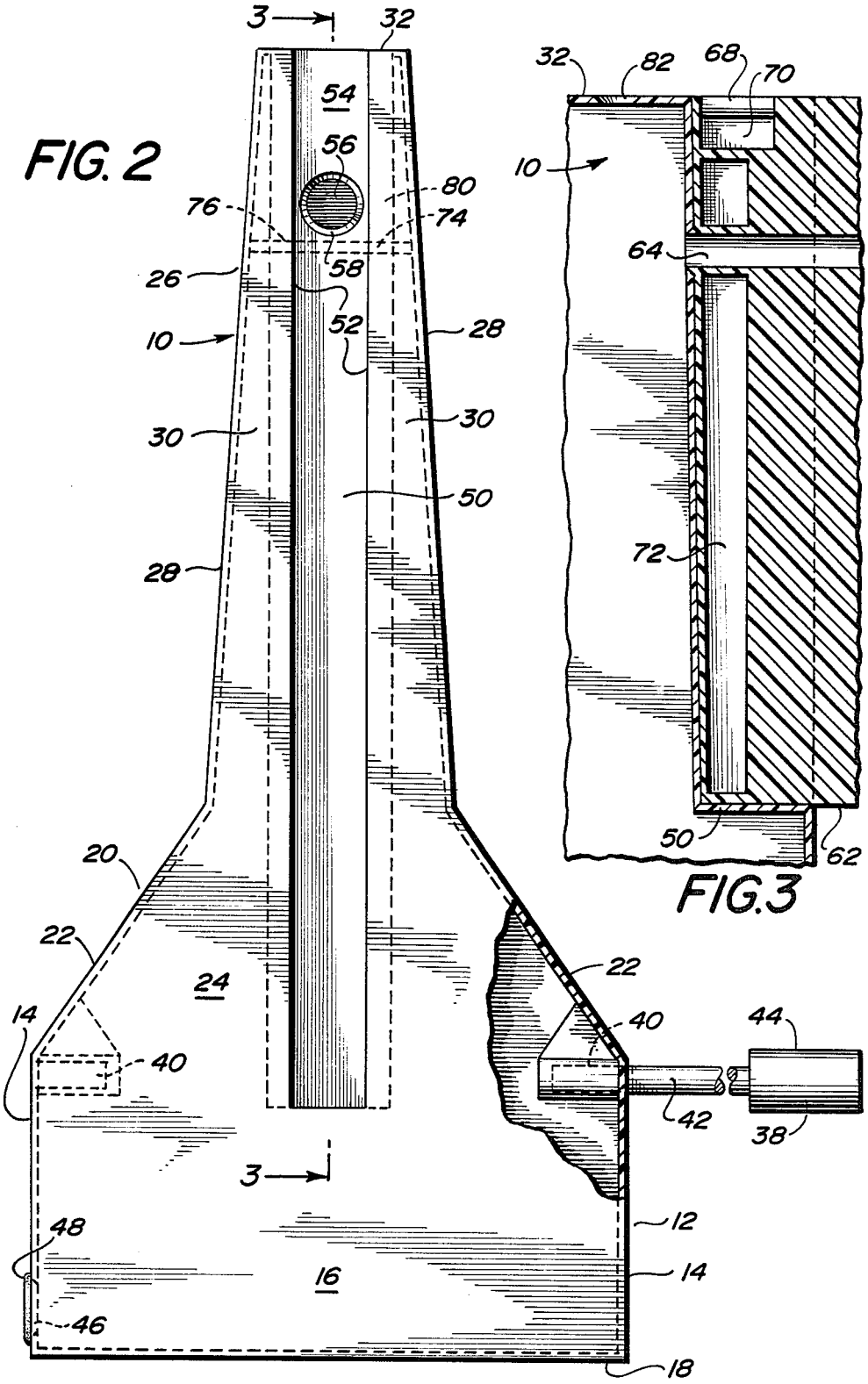
FIG. 3 is a foreshortened view along line 3—3 of FIG. 2 with a key positioned in the groove of the barrier.
Figure 6:
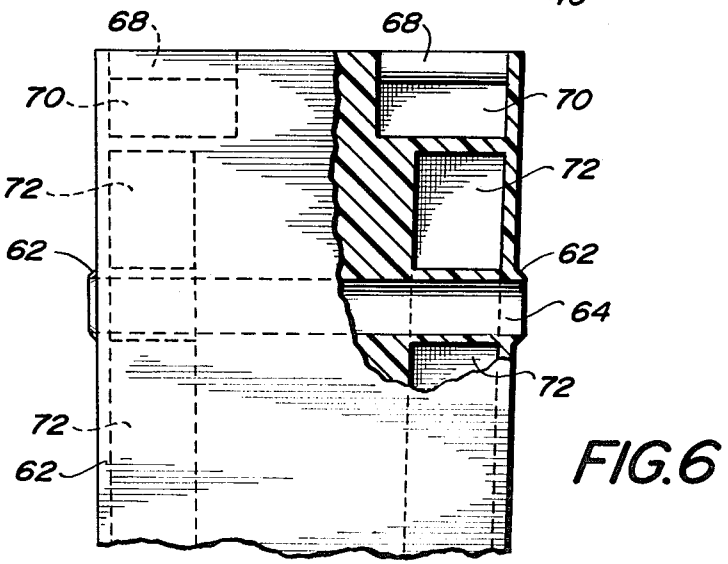
FIG. 6 is a partial elevational view of the key with a broken section.
Figure 5:
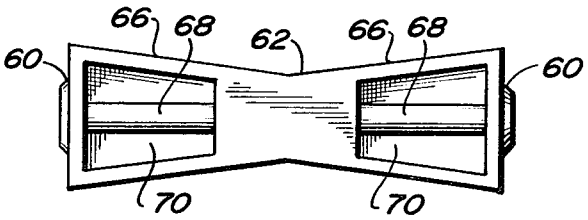
FIG. 5 is a plan view of the key used to connect adjacent barriers together.

Referring to FIG. 5, key 62 has tapered side walls 66 adapted to match the tapered side walls 52 of the groove 50 in adjoining barriers 10 and secure adjacent barriers 10 to each other. As best shown in FIG. 6, the key 62 includes handles 68 which are set in recessed areas 70 at the top of the key 62, and a through opening 64. The handles 68 allow the key 62 to be easily inserted and removed from the grooves 50 of the barriers 10. As shown in FIG. 3, the through opening 64 in the key 62 is positioned to fit and to match and be aligned with the opening 56 in the base 54 of the groove 50 and thus allow liquid to pass from one barrier 10 to the adjacent barrier 10, as shown in FIG. 3. In order to reduce its weight, key 62 includes interior hollow portions 72.

Referring to FIG. 4, positioned within the barrier 10 are two interior baffles 74. The baffles 74 extend in a plane transverse to the longitudinal axis of elongated barrier 10 and also transverse to the side walls 14 of the base 12 of the barrier 10 and are connected to the bottom 18, side walls 14, side walls 22 and side walls 28, in a liquid tight fashion. As best shown in FIG. 2, the top edges 76 of the baffles 74 are spaced from the top 32 of the barriers 10. Thus the baffles 74 form three liquid tight compartments 78 in the barrier 10, as shown in FIG. 4. The baffles 74 extend upwardly from the bottom 18 of the barrier at an acute angle of about 30 degrees to the bottom 18 of the barrier 10. The compartments 78 formed by the baffles 74 are of substantially equal volume and allow the liquid in the barrier 10 to be evenly distributed throughout the barrier 10, especially should the barrier 10 be placed on a surface which is inclined for up to about 9 degrees. The passageways 80 in the barrier 10 which are formed by the top edge 76 of the baffles 74 and the top 32 of the barrier 10 allow liquid to flow from one compartment 78 to the next compartment 78.

The barrier 10 is made of a semi-rigid plastic material selected from a group of materials consisting of low density polyethylene, ABS (Acrylonitrile Butadene Styrene), HIPS (High Impact Styrene), and Polycarbonate. These plastic materials are all inherently tough and semi-rigid and more energy absorbing than other existing materials. These polymeric materials will deform and elongate but will not fail in a brittle manner at energy inputs which cause other materials to undergo brittle failure.

In addition, the surface of the above group of materials is inherently smoother than current materials from which barriers are made and people and vehicles contacting the barrier at an angle will be less likely to suffer massive abrasion injuries or damage. The above materials are also unaffected by water and have excellent basic resistance to weathering, leaching or biodegradation. The above materials will also retain their mechanical and chemical properties at low ambient temperatures.

It has been determined that a plastic barrier 10 made from the above materials having a thickness of about $\frac{1}{8}$ inch to about 1 inch will perform satisfactorily in service. A plastic barrier 10 which is 16 feet long and made according to this invention weighs about 400 pounds when it is not filled with a liquid, and about 2565 pounds when it is filled with a liquid, with each compartment 78 holding about 855 pounds.

Under certain circumstances, it may be desirable to provide a plastic barrier 10 with a length of about 8 feet so that the barrier 10 may be more easily handled and transported. A barrier 10 having a length of about 8 feet would weigh about 200 pounds when empty and about 1283 pounds when filled with water.

When the term "semi-rigid" is used it means that the barrier is made from a material which is capable of allowing the barrier to hold its own shape under normal use, however the barrier will flex before breaking, as opposed to a "rigid" barrier which also holds its own shape but will not flex before breaking and a "non-rigid" barrier which will not hold its own shape.

In practice, the barriers 10 while empty of any liquid are placed on vehicles and transported to the site near where they are to be used. The barriers 10 are then removed from the vehicles with the handle/reflectors 38 placed in recesses 40 in the side walls 14 of the barriers 10 to facilitate handling of the barriers 10. The barriers 10 with the aid of the handles are manually or otherwise then positioned in the desired location where a highway barrier is desired. Keys 62 are inserted into the grooves 50 of adjacent barriers to secure the barriers 10 to each other. Next, an inspection is made to check to see that all discharge openings 46 are closed by means of plugs 48. Handle/reflectors 38 are removed from the recesses 40 and inserted into recesses 36 in the top 32 of the barriers 10 to act as reflectors. Next a liquid is supplied to one or more filling openings 82 in the top 32 of the barrier 10. As the liquid fills the compartments 78 of a barrier 10 the liquid will pass to the next barrier 10 through openings 56 in the base 54 of the grooves 50 of the barriers 10 and through openings 64 in the keys 62. Obviously to avoid the barriers 10 from becoming air bound, openings 82 in the top 32 of the barriers 10 may be opened. In addition, the last barrier 10 in the line of barriers 10 should have its opening 56 closed by a suitable plug.

The preferred liquid to be supplied to the barriers 10 is water due to its availability and cost. If water is used and there is a possibility that the ambient temperature will drop below the freezing point of water, a suitable anti-freeze compound may be added to the water. Obviously other liquids than water may be used to fill the barriers.

Although I have described my invention hereinabove in considerable detail, I do not wish to be limited narrowly to the exact and specific particulars disclosed, but I may also use such substitutes, modifications and equivalents as are included within the scope of my invention or pointed out in the appended claims.

I claim:

1. A highway barrier structure comprising (a) an elongated container including a base portion having side walls, end walls and a bottom with said side walls and end walls of said base portion rising substantially vertically from and connected to said bottom of said base portion; an intermediate portion having side walls and end walls, said end walls of said intermediate portion rising substantially vertically from and connected to said end walls of said base portion, said side walls of said intermediate portion extending inwardly toward each other and rising upwardly from and connected to said side walls of said base portion; and an upper portion having side walls, end walls and a top, said end walls of said upper portion rising substantially vertically from and connected to said end walls of said intermediate portion, said side walls of said upper portion rising upwardly from and connected to said side walls of said intermediate portion, said top connected to the upper ends of said end walls and said side walls of said upper portion, (b) said side walls, end walls, bottom and top of said base portion, intermediate portion and upper portion being made from a semi-rigid plastic material having a thickness of about $\frac{1}{8}$ inch to about 1 inch to form an integral, hollow, liquid tight container, (c) a plurality of baffles positioned within said container and extending in a plane transverse to the longitudinal axis of said container and connected to said bottom and said side walls of said base portion, said side walls of said intermediate portion, and said side walls of said upper portion, the top edges of said baffles spaced from the top of said container, to form a plurality of liquid tight compartments within said container with passageways near the top portion of the inside of the container to allow a liquid to flow from one compartment to the adjacent compartment, (d) each of said liquid tight compartments having substantially the same volume.

(e) means in the upper portion of said container to fill said container with a liquid, and (f) means in the base portion of said container to discharge liquid from said container.

2. The highway barrier of claim 1 wherein said baffles extend upwardly from said bottom at an acute angle to said bottom of said base portion.

3. The highway barrier of claim 2 wherein said compartments are filled with a liquid.

4. The highway barrier of claim 1 wherein a plurality of elongated containers are aligned end to end with each container including a groove at each end thereof, said groove having an outside width less than the width of the base of said groove, a key extending within adjacent grooves having surfaces which closely fit within said grooves to secure adjacent containers to each other, and said containers are filled with a liquid.

5. The highway barrier of claim 1 wherein said plastic material is material taken from a group consisting of low density polyethylene, ABS (Acrylonitrile Butadene Styrene), HIPS (High Impact Styrene), and Polycarbonate.

6. The highway barrier of claim 1 wherein said container includes a groove at each end of said container, said groove extends from the top of said container and terminates short of the bottom of said container, said groove has an outside width less than the width of the base of the groove and adapted to receive a key to secure adjacent barriers to each other.

7. The highway barrier of claim 1 further comprising a plurality of recesses extending substantially horizontal in the side walls of said base portion, said recesses spaced along the length of said container and adapted to receive handle/reflector means having a shaft at one end and a reflector at the other end, said shaft adapted to be placed in said recess to facilitate moving the container.

8. The highway barrier of claim 6 further comprising a plurality of recesses extending substantially vertically in the said top of said container and adapted to receive said shaft of said handle/reflector means.

9. The highway barrier of claim 6 wherein said key includes a through opening which is in alignment with openings in the base of said grooves to allow liquid to flow from one barrier to the adjacent barrier.

10. The highway barrier of claim 6 wherein said key includes handle means located in recessed areas in the top of said key.

* * * * *